US005603903A

United States Patent [19]

Copelan

[11] Patent Number: 5,603,903

[45] Date of Patent: Feb. 18, 1997

[54] SPECIMEN-CONTAINER HOLDER APPARATUS TO PREVENT CROSS CONTAMINATION

[76] Inventor: Herbert W. Copelan, 8706 Via Reale, Boca Raton, Fla. 33496

[21] Appl. No.: 574,271

[22] Filed: Dec. 18, 1995

[51] Int. Cl.[6] ..... B01L 9/00

[52] U.S. Cl. ..... 422/104; 422/102; 422/103; 436/174; 436/180; 128/760; 220/751

[58] Field of Search ..... 422/61, 102, 100, 422/104, 103; 436/174, 180, 810, 908; 128/749, 760; 220/737, 738, 751, 759, 752

[56] References Cited

U.S. PATENT DOCUMENTS 5,133,935 7/1992 Copelan ..... 422/61
5,174,965 12/1992 Jones et al. ..... 422/102
5,223,221 6/1993 Copelan ..... 422/61
5,256,537 10/1993 Phillips et al. ..... 435/7.1
5,403,551 4/1995 Galloway et al. ..... 422/58

*Primary Examiner*—Long V. Le

[57] ABSTRACT

This invention is a container holder that eliminates the potential of hand-restricting apparatus to cause cross contamination of urine specimens collected with the apparatus. The holder has a dismountable element (7) to directly support a specimen container (3). It has a fixed element (8) to temporarily position the dismountable one. The fixed element is a permanent part of the apparatus but safely distant from, and out of the direction of, possible soiling by voided urine. The dismountable element is discarded after a single use, unlike the previously taught apparatus, in which the entire holder is a fixed unit of the apparatus, continually reused, and a potential source of contamination.

1 Claim, 2 Drawing Sheets

SPECIMEN-CONTAINER HOLDER APPARATUS TO PREVENT CROSS CONTAMINATION

This invention is a container holder for preventing cross contamination of urine specimens collected with apparatus that prevents tampering by restricting the hands of a person donating a specimen.

BACKGROUND

Hand-restriction apparatus to prevent tampering with urine specimens (U.S. Pat. Nos. 5,223,221 and 5,133,935), engages a person's two hands simultaneously and continuously while a specimen container is exposed. The apparatus requires that urine be voided directly into a specimen container held only by the apparatus. Such voiding can soil the part of the apparatus supporting the container and thereby contaminate a subsequent specimen, with gravely misleading results.

BRIEF DESCRIPTION OF THE INVENTION

This container holder eliminates the potential of hand-restricting apparatus to cause cross contamination of urine specimens collected with the apparatus. The holder uses a dismountable element to support the specimen container and a fixed element to temporarily position the dismountable one. The fixed element is a permanent part of the apparatus but safely distant from, and out of the direction of, possible soiling by voided urine. The dismountable element is discarded after a single use, unlike the previously taught apparatus, in which the entire container holder is a fixed unit of the apparatus, continually reused, and, therefore, a potential source of contamination.

DETAILED DESCRIPTION OF INVENTION

Figure 1:
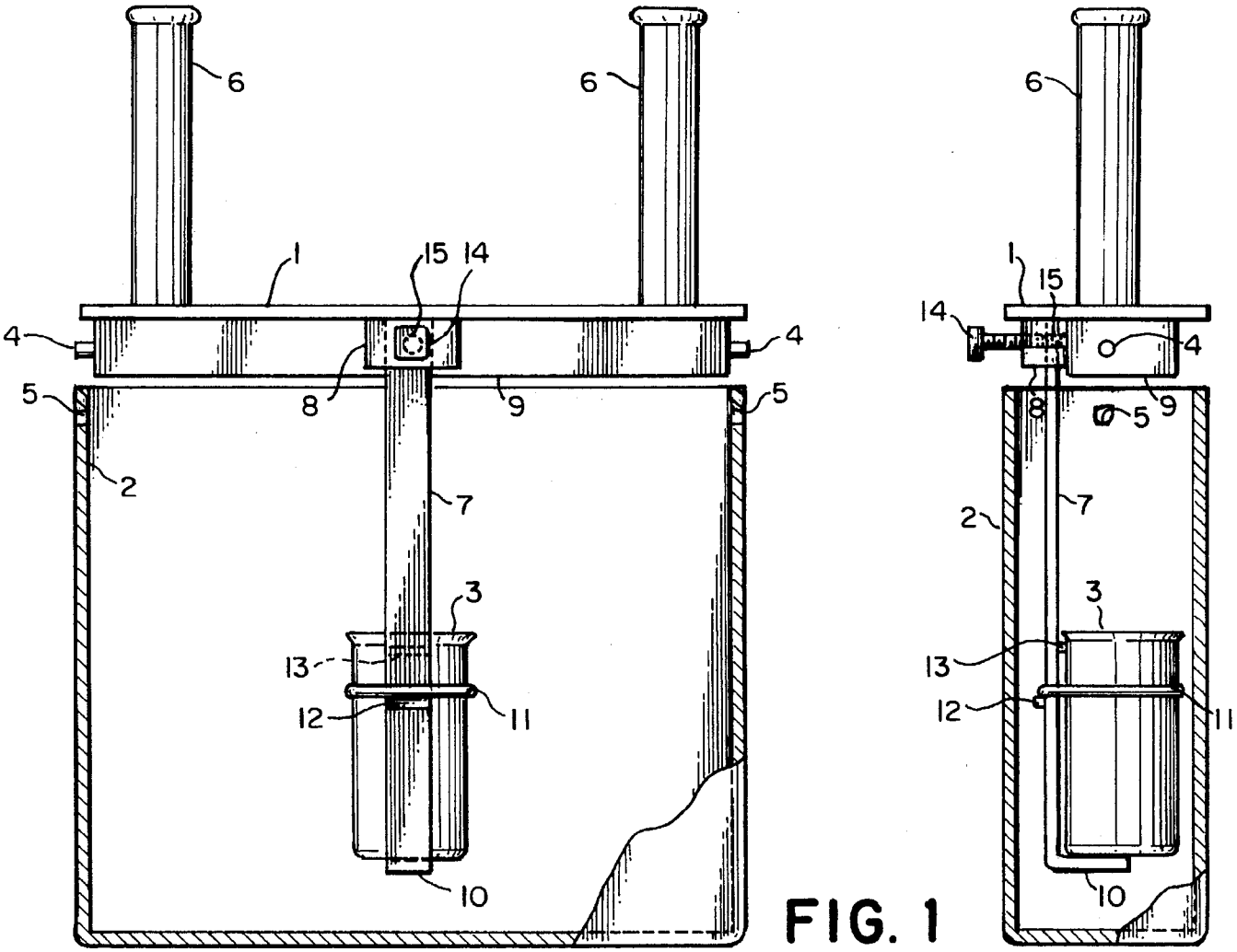
FIG. 1 shows a hand-restricting apparatus with the dismountable element of the container holder in its fixed element.
Figures 2, 3:
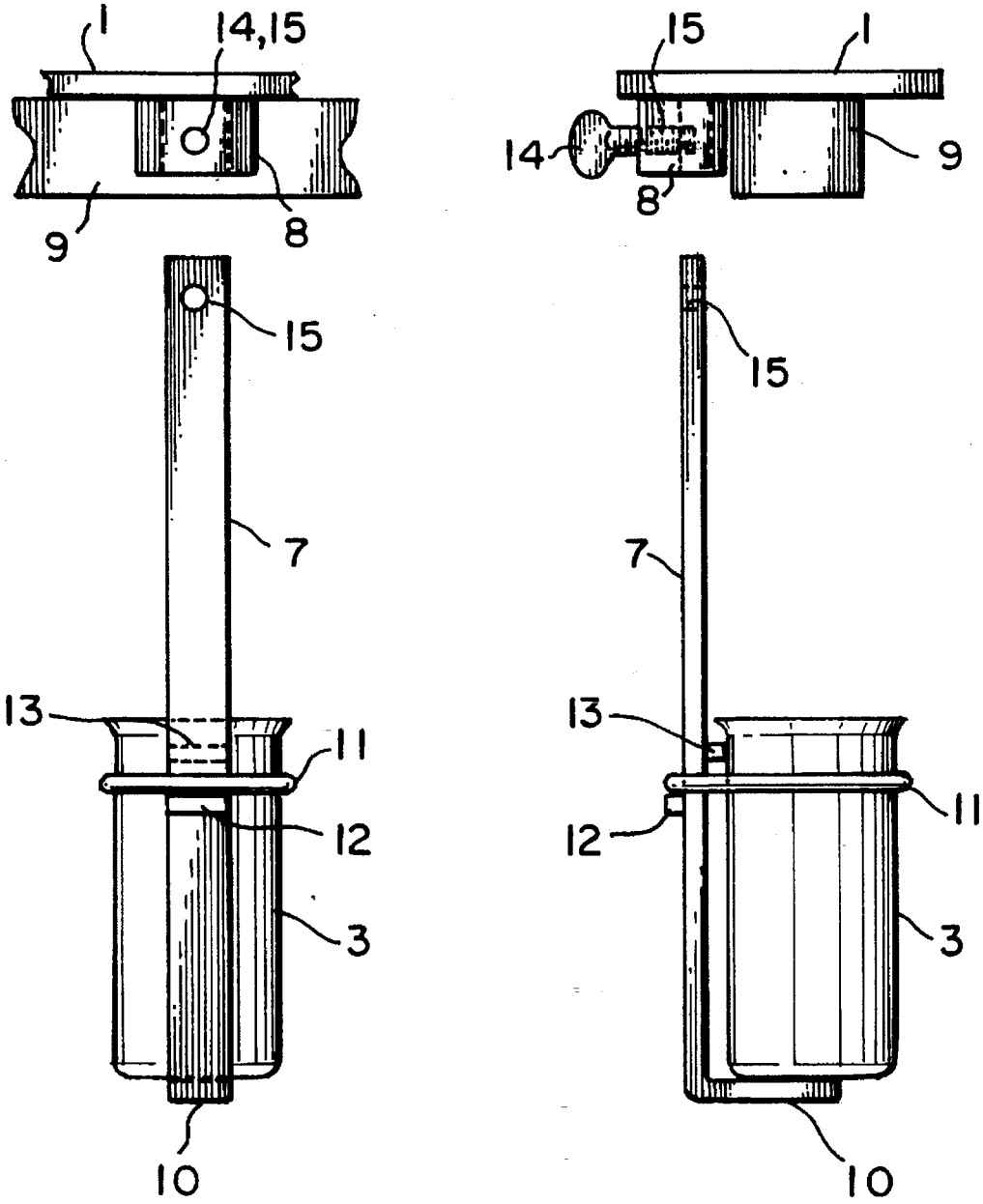
FIG. 2 shows the dismountable element.
FIG. 3 shows the fixed element as a rectangular socket bonded to the apparatus.

FIG. 1 shows cross-sectional rear and side views of a hand-restricting apparatus with the upper section (1) partly lifted off the lower section (2). The views do not show that the walls of the lower section continue, so as to form an enclosure that is open only at the top. To secure the specimen container (3) inside the apparatus, the upper section (1) is placed on the lower section (2), and the latching pistons (4) are projected through the latching ports (5). The latching pistons (4) are shown in their projected position to illustrate that they then also block reassembly of the two sections. The two hand holds (6), unlocked for each operation, must be grasped simultaneously and continuously to retract the pistons (4) from the latch ports (5). This allows the upper section (1) with the attached container (3) to be lifted out, positioned for direct voiding, and then replaced.

The container (3) is supported by the dismountable element (7) of the container holder. The dismountable element (7) is shown mounted in the fixed element (8). The fixed element (8) is permanently attached to the upper section (1) of the apparatus, behind the compartment (9) containing the latching mechanism.

The dismountable element, when mounted, extends down from the fixed element (8). Its lower end is shown with an arm (10) supporting the container (3). The element is configured to allow a disposable band (11) to be easily placed to secure the container (3). A positioning ridge (12) indicates the position for placing the band. The breadth of the dismountable element prevents the container from rolling. A stud (13) serves to position the container so that its opening is at a predetermined distance from the permanent part of the apparatus. Such positioning is useful for containers of different lengths. It works best when the container is held only by the band, and its bottom is free. A stud (13) can also serve to incline the container (3) for convenient filling and to keep its opening above the contiguous part of the holder. The dismountable element (7) should be made of inexpensive material, such as plastic, but must be stiff enough to maintain the container in position.

The fixed element (8) mounts the disposable element (7) so that it can be easily and securely joined and easily separated. The fixed element (8) is shown as a rectangular socket that fits over the upper end of the dismountable element (7). The fixed element (8) may be incorporated in the apparatus as a slot, or other receiver, or it may be secondarily added by welding or other fastening. Preferably, the fixed element (8) is located on the underside of upper section (1) and away from a person using the apparatus for voiding. The figures show the element bonded to the back side of the compartment (9). The compartment (9) extends below the fixed element (8), shielding it from the unlikely possibility of soiling that might secondarily contaminate the dismountable element (7) and, eventually, the container (3).

The fixed element (8) uses a keeper (14) to lock in the dismountable element (7). The keeper (14) is shown partly extracted from its locking position. When the keeper is spring-loaded and asymmetrical, the dismountable element (7) can be snapped in and secured until the keeper (14) is deliberately withdrawn from its recess (15) in the dismountable element (7). An access door (not shown), preferably in the back wall of the lower section of the apparatus, allows easy changing of the dismountable element (7) with the container (3) attached. A notch (not shown) in the back wall of the lower section (2) allows passage for, and access to, the keeper (14). Cost is not critical for the fixed element (8).

The dismountable element (7), as well as a container holder that is entirely a fixed unit in the apparatus, are both adaptable to additional means for reducing any chance of contamination.

The container holder described above is useful for apparatus in which the specimen container is lifted out for voiding. In other apparatus the container remains in an enclosure. In such apparatus only the enclosure cover is removed, exposing the container for direct voiding. The disposable element then, preferably, is a platform to support the container and rests passively on a fixed element, configured and placed to support the disposable element in the desired position.

The description above is meant to explain the invention and illustrate its embodiment, rather than to limit its scope. The dismountable element, for example, can have various longitudinal and cross-sectional shapes. Either element of the joint can be the male or female member, and various joints, sockets, sleeves, and connections are feasible. Container supports can use lugs, clamps, receptacles, forks and other means. Many materials are suitable for construction. The scope of the invention should, therefore, be determined by the claims and their equivalents.

I claim:

1. An improved specimen-container holder apparatus for restricting the hands of a person using said apparatus to donate a specimen into a specimen container; said apparatus comprising an upper section and a lower section, which two sections latch together to form an enclosure for said specimen container, said upper section having a portion exposed to said enclosure; said upper section comprising locking latch means for securing said upper section to said lower section; two hand holds for operating said locking latch means, said locking latch means for preventing closing said enclosure when said enclosure is open, said enclosure can be opened and closed only by simultaneously and continuously grasping said two hand holds; and said improved specimen-container holder apparatus comprises:

a. a detachable element for supporting and positioning said specimen container, b. a permanent element structurally integrated in said upper section of said apparatus at said portion, and c. connecting means for releasably mounting said detachable element to said permanent element; whereby said detachable element can be discarded after use, thereby preventing said detachable element from contaminating a specimen subsequently donated when said apparatus is used.

* * * * *